US006750828B1

(12) United States Patent
Wixforth et al.

(10) Patent No.: US 6,750,828 B1
(45) Date of Patent: Jun. 15, 2004

(54) SPIRAL ANTENNA

(75) Inventors: Thomas Wixforth, Hildesheim (DE); Eberhard Gschwendtner, Karlsruhe (DE); Jean Parlebas, Pfinztal (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/019,824

(22) PCT Filed: Jun. 26, 2000

(86) PCT No.: PCT/DE00/01991

§ 371 (c)(1),
(2), (4) Date: May 10, 2002

(87) PCT Pub. No.: WO01/03239

PCT Pub. Date: Jan. 11, 2001

(30) Foreign Application Priority Data

Jun. 29, 1999 (DE) ..... 199 29 879

(51) Int. Cl.[7] ..... H01Q 1/36
(52) U.S. Cl. ..... 343/895; 343/853
(58) Field of Search ..... 343/895, 853, 343/789, 850, 860, 864

(56) References Cited

U.S. PATENT DOCUMENTS 3,019,439 A 1/1962 Reis et al. ..... 343/895
4,609,888 A 9/1986 Corzine et al. ..... 333/34
5,936,595 A * 8/1999 Wang ..... 343/895
6,130,652 A * 10/2000 Goetz et al. ..... 343/895

FOREIGN PATENT DOCUMENTS

GB 2 207 556 2/1989
GB 2 207 566 A * 2/1989 ..... H01Q/9/27

OTHER PUBLICATIONS

M. Y. Li, et al., Broadband Coplanar Waveguide–Coplanar Strip–Fed Spiral Antenna, Electronic Letters, Jan. 5, 1995, vol. 31, No. 1,.

Robert G. Corzine et al., "Four–Arm Spiral Antennas", Artech House.

Tarusawa et al., "Uniplanar MMIC—A Proposed New MMIC Structure," IEEE Transactions on Microwave Theory and Technics, vol. 35, No. 6, pp. 576–581, Jun. 1987.

* cited by examiner

*Primary Examiner*—Hoang V. Nguyen
(74) *Attorney, Agent, or Firm*—Kenyon & Kenyon

(57) ABSTRACT

A spiral antenna which can be supplied in different modes with different transmission characteristics is described. The spiral antenna includes four approximately parallel, electrically conducting spiral arms. The spiral arms are each connected to a coplanar conductor at their inner spiral arm ends for supplying and/or receiving signals.

20 Claims, 4 Drawing Sheets

SPIRAL ANTENNA

FIELD OF THE INVENTION

The present invention relates to a spiral antenna.

BACKGROUND INFORMATION

Four-arm spiral antennas are described in the book *Four-Arm Spiral Antennas* by R. G. Corzine, J. A. Moskos, Artech House, 1990.

SUMMARY OF THE INVENTION

The spiral antenna according to the present invention has the advantage over the related art that the spiral arms are connected on their respective inner spiral arm ends to a coplanar conductor for supplying and/or receiving signals. By using the coplanar conductor, it is possible to eliminate power supply networks for adjusting the phase angles at the incoming feed points of the spiral antenna or for making the electric field to be supplied symmetrical or asymmetrical, and thus to reduce costs.

Another advantage is that, due to the use of the coplanar conductor, the spiral antenna can be operated in a first mode to generate an omnidirectional transmission characteristic and also in a second mode to generate a directional transmission characteristic normal to the plane of the spiral. In this way, the spiral antenna can be used as a combination antenna for various wireless services.

It is especially advantageous that the coplanar conductor and the spiral antenna can be applied to different carrier materials. The transition from the coplanar conductor to the spiral antenna does not depend on any sudden change in the dielectric constant. Thus a carrier material having a low permittivity can be used for the spiral antenna, thus achieving a good transmission. At the same time, a carrier material having a high permittivity can be selected for the coplanar conductor, thus permitting a reduction in the length of the coplanar conductor while suppressing parasitic radiation from the coplanar conductor, so that the coplanar conductor can be made independent of the radiation field of the spiral antenna Another advantage is that the coplanar conductor is designed with a taper at least in part. In this way, no additional network is necessary for adapting the impedance of the coplanar conductor to the input impedance of the spiral antenna.

DETAILED DESCRIPTION

Figure 1:
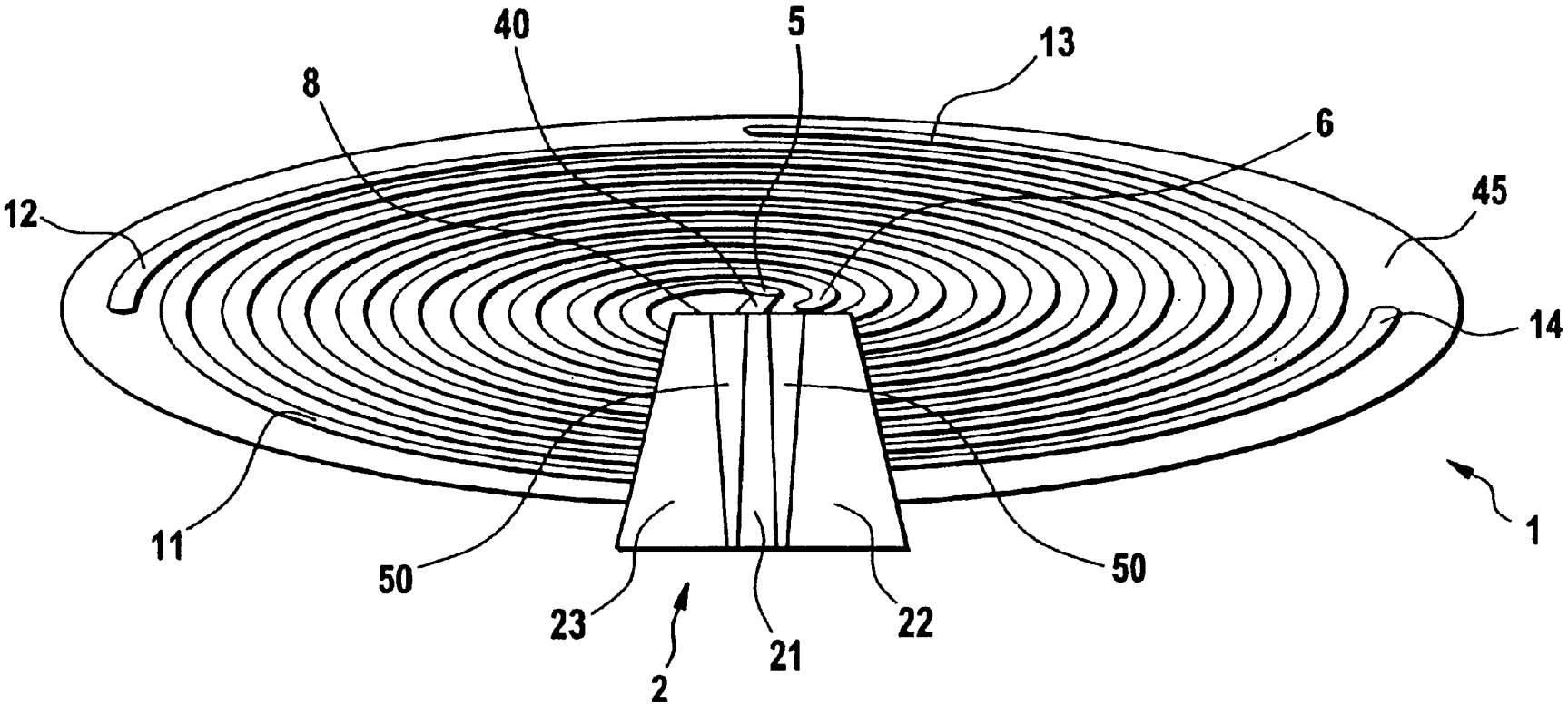
FIG. 1 shows a three-dimensional view of a spiral antenna having a coplanar conductor.
Figure 3:
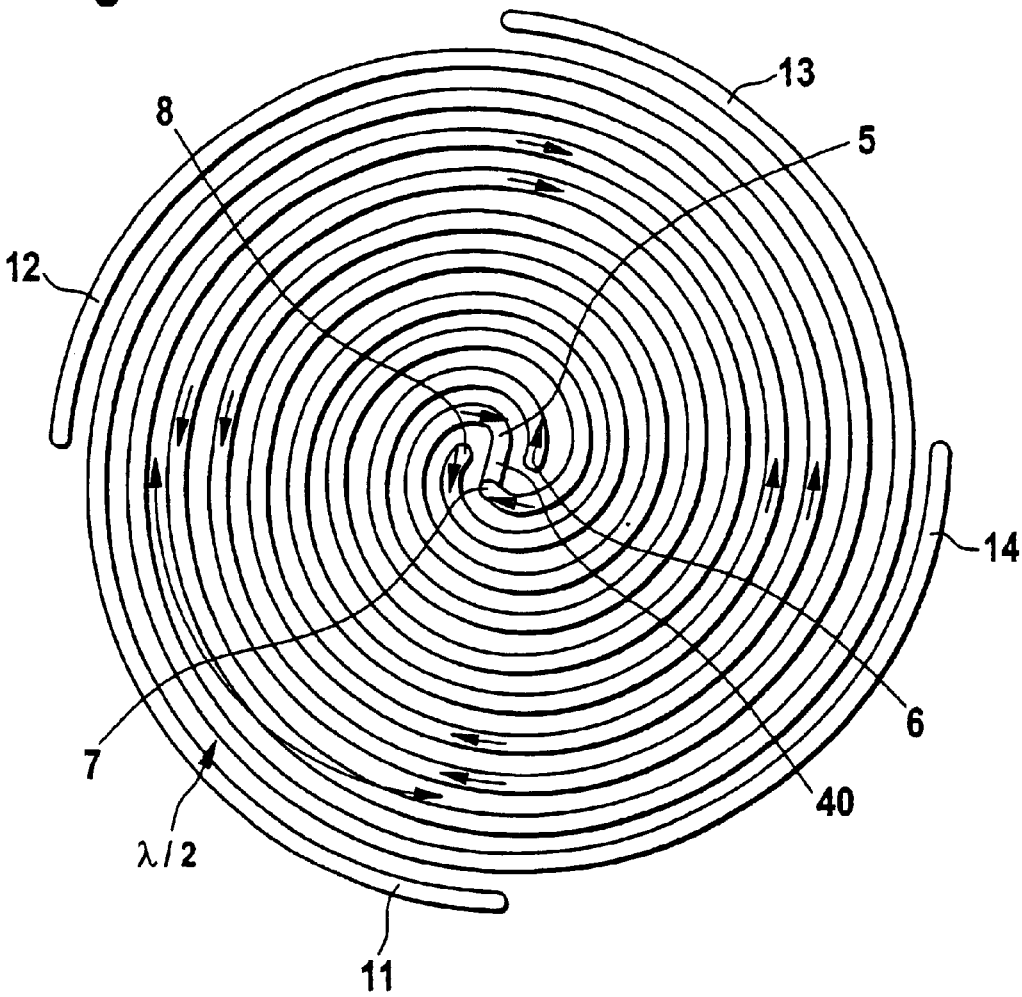
FIG. 3 shows a top view of a spiral antenna having current vectors for an omnidirectional transmission mode.
Figure 4:
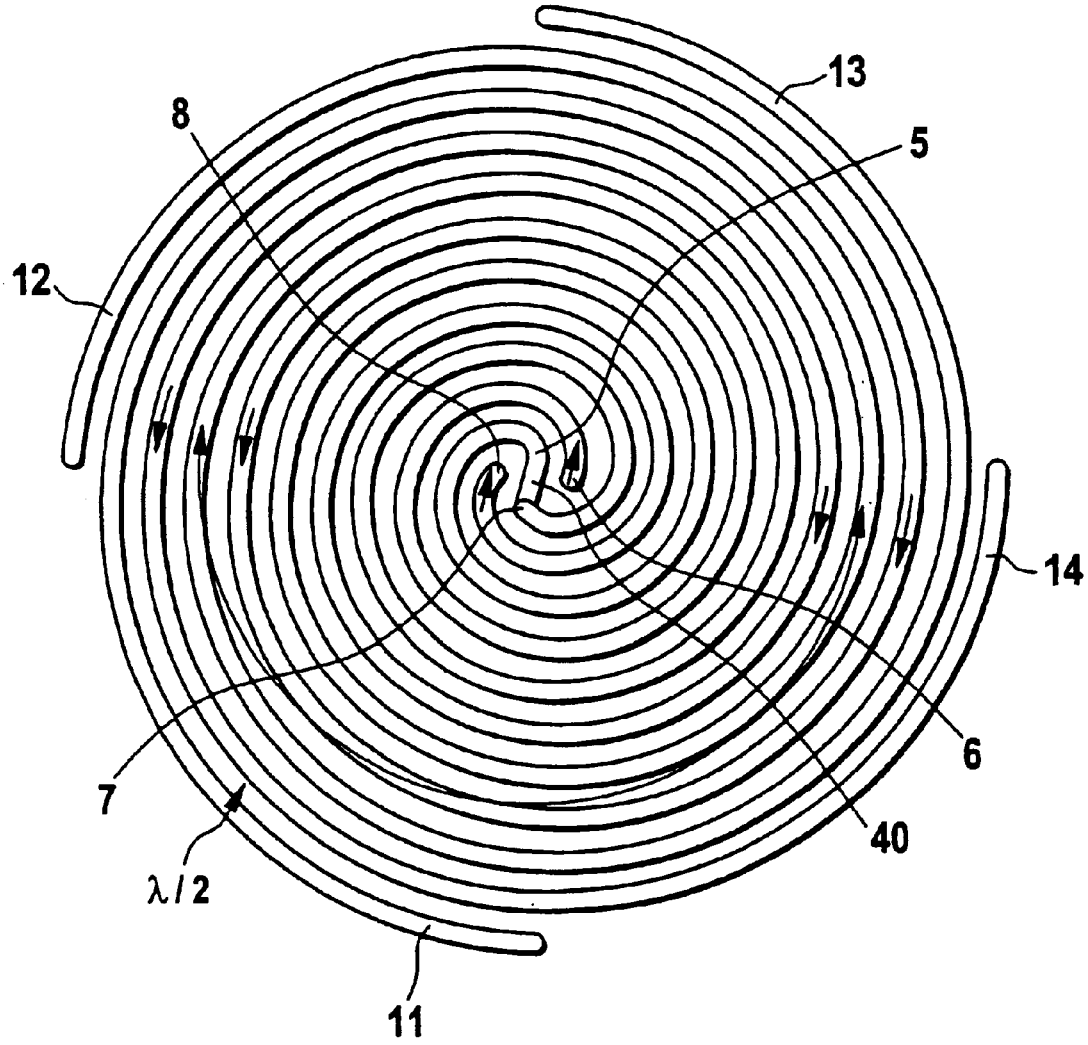
FIG. 4 shows a spiral antenna having current vectors for a directional transmission.

FIG. 1 shows a spiral antenna 1 having a first spiral arm 11, a second spiral arm 12, a third spiral arm 13 and a fourth spiral arm 14. At the center of the spiral antenna, first spiral arm 11 has a first inner spiral arm end 5, second spiral arm 12 has a second inner spiral arm end 6, third spiral arm 13 has a third inner spiral arm end 7, and fourth spiral arm 14 has a fourth inner spiral arm end 8. Third inner spiral arm end 7 is not shown in FIG. 1 because of the perspective view, but it is shown in the top view in FIGS. 3 and 4. Four spiral arms 11, 12, 13, 14 are guided approximately in parallel. In addition, FIG. 1 also shows a coplanar conductor 2 having a first inner conductor 21, a first reference potential surface 22 and a second reference potential surface 23. Four spiral arms 11, 12, 13, 14 are made of an electrically conducting material and are applied to a first carrier material 45. Spiral arms 11, 12, 13, 14 may be made of a metal, for example. First inner conductor 21, first reference potential surface 22 and second reference potential surface 23 are also made of an electrically conducting material and are applied to a second carrier material 50. First carrier material 45 and second carrier material 50 may be the same carrier material. However, first carrier material 45 may also be different from second carrier material 50. First inner spiral arm end 5 is connected electrically to third inner spiral arm end 7 over an electrically conducting first bridge 40, which is applied to first carrier material 45, for example. First inner spiral arm end 5 and third inner spiral arm end 7 according to FIGS. 3 and 4 are opposite one another. Second inner spiral arm end 6 and fourth inner spiral arm end 8 are also opposite one another according to FIGS. 3 and 4, but without being connected to one another by an electrically conducting bridge. Spiral arms 11, 12, 13, 14 are supplied with signals emitted from spiral antenna 1 over corresponding inner spiral arm ends 5, 6, 7, 8 and coplanar conductor 2. According to FIG. 1, coplanar conductor 2 is perpendicular to the plane of spiral antenna 1 and is guided in the middle of spiral antenna 1. First inner conductor 21 is connected electrically to first bridge 40. First reference potential surface 22 is electrically connected to second inner spiral arm end 6. Second reference potential surface 23 is electrically connected to fourth inner spiral arm end 8. Coplanar conductor 2 supplies spiral antenna 1 with signals emitted by spiral antenna 1 and may also be used additionally or alternatively for receipt of signals by spiral antenna 1.

Spiral antenna 1 is called self-complementary if its spiral arms 11, 12, 13, 14 in a 45° rotation are completely imaged on the areas forming the clearances between spiral arms 11, 12, 13 and 14 before rotation. Accordingly, in such a rotation, the clearance before rotation is imaged completely on the areas formed by spiral arms 11, 12, 13, 14 before the rotation. The axis of rotation in both cases passes through the center of spiral antenna 1 perpendicular to the plane of spiral antenna 1 and is referred to below as the center axis.

Figure 2:
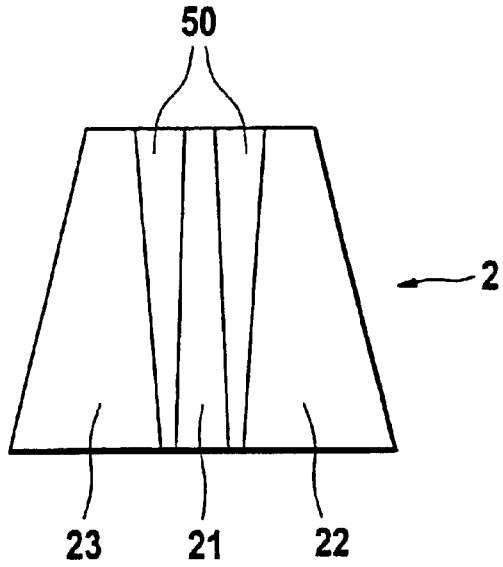
FIG. 2 shows a top view of a tapered coplanar conductor.

If the width of spiral arms 11, 12, 13, 14 is selected so that the spiral is self-complementary, this yields an input impedance of 94Ω at inner spiral arm ends 5, 6, 7, 8. The input impedance increases with thinner spiral arms and decreases with wider spiral arms, each in relation to the width of the clearance between spiral arms 11, 12, 13, 14. Adapting this impedance to the impedance of 50Ω, which is required traditionally, necessitates transformation of the impedance, which can be accomplished by tapering of coplanar conductor 2, for example. In FIG. 2, coplanar conductor 2 is shown again alone, with the same reference numbers identifying the same elements as in FIG. 1. According to FIGS. 1 and 2, first inner conductor 21, first reference potential surface 22 and second reference potential surface 23 become wider in the direction of a power supply network and/or receiving network (not shown in FIGS. 1 and 2) on the side of coplanar conductor 2 facing away from spiral antenna 1, starting from the terminals on spiral antenna 1. The increase in width is linear according to FIGS. 1 and 2, thus resulting in a linear tapering of coplanar conductor 2. However, nonlinear tapering of the coplanar conductor may also be provided, e.g., exponential tapering. The length over which coplanar conductor 2 is tapered must amount to at least one fourth of the wavelength of the average operating frequency of spiral antenna 1. Depending on the width of spiral arms 11, 12, 13, 14 and on the input impedance which thus results on inner spiral arm ends 5, 6, 7 and 8, this input impedance can be adapted to the required 50Ω through appropriate tapering of coplanar conductor 2, so that coplanar conductor 2 can be adapted flexibly to the geometry of spiral antenna 1 through this tapering.

Spiral antenna 1 can easily be supplied with power for transmission of signals over coplanar conductor 2, and two different transmission characteristics can be produced. First, it is an omnidirectional transmission characteristic having a zero position perpendicular to the plane of spiral antenna 1. The omnidirectional transmission characteristic is especially advantageous for mobile use with terrestrial wireless services. Second, this is a transmission characteristic having a main beam direction perpendicular to the plane of spiral antenna 1, which is especially suitable for use with satellite-supported navigation and communication services using circular polarization. Thus, with spiral antenna 1 it is possible to implement a first mode or an omnidirectional mode having an omnidirectional transmission characteristic and a second mode or a zenith mode having a transmission characteristic with a main beam direction perpendicular to the plane of spiral antenna 1, referred to below as zenith radiation.

To illustrate the production of the various modes or transmission characteristics, FIGS. 3 and 4 illustrate the same spiral antenna 1, with the same reference numbers characterizing the same elements. The single arrows in FIGS. 3 and 4 indicate current vectors on spiral arms 11, 12, 13, 14 as a snapshot. FIG. 3 shows the current distribution for the omnidirectional mode, and FIG. 4 shows the current distribution for the zenith mode.

In the omnidirectional mode according to FIG. 3, first spiral arm 11 and third spiral arm 13 are supplied with power in phase. Second spiral arm 12 and fourth spiral arm 14 are also supplied with power in phase but phase-shifted by 180° with respect to first spiral arm 11 and third spiral arm 13. This is indicated by the direction of the current vectors on inner spiral arm ends 5, 6, 7, 8, i.e., at the input points according to the one-shot display of the current distribution shown in FIG. 3. According to FIG. 3, the current vectors of adjacent spiral arms are in phase opposition on their inner spiral arm ends, i.e., they are phase-shifted by 180°. With the help of this current distribution at the input points and geometric considerations, a transmission region of spiral antenna 1 can be determined. Spiral antenna 1 emits at the points where currents in adjacent spiral arms are in phase. Because of the different path lengths of the spiral arms from a first fixed angle $\phi_0$ to a second fixed angle $\phi_1$, the phase difference between the waves running in adjacent spiral arms changes. Both fixed angles $\phi_0$ and $\phi_1$ are defined in a cylindrical coordinate system whose central axis runs perpendicularly through the center of spiral antenna 1. The phase difference of 180° between adjacent spiral arms at the input points or at the inner spiral arm ends at the center of the spiral antenna is reduced to 0° at a first radius $r_1$.

Adjacent spiral arms can be in phase with a path difference of one wavelength λ or a multiple of wavelength λ between points that are arranged symmetrically with the center axis of spiral antenna 1 and are opposite one another on the spiral arms, because currents at such symmetrically opposed points are directed in opposite directions in space regardless of their distance from the center of spiral antenna 1. This path difference corresponds to the distance on the adjacent spiral arms to be covered between the opposite points. On these opposite points on the spiral arms, the currents are directed in opposite directions in space, as shown in FIG. 3. In the case of the transmission region of spiral antenna 1 closest to the center of spiral antenna 1 under this condition, said path difference corresponds to wavelength λ.

Transmission thus occurs at the point where the circumference of the spiral arms amounts to 2λ, where λ is the wavelength of the wave on the spiral arms. Since first radius $r_1$, cannot be larger than radius r of spiral antenna 1, a boundary condition is defined by $$2\lambda=2\pi r_1=2\pi r.$$

This yields a first lower cutoff frequency $f_{min1}$ of spiral antenna 1 in the omnidirectional mode as follows:

$$f_{min1}=c/(\pi r),$$

where c is the rate of propagation of the wave on spiral antenna 1. Spiral antenna 1 emits in the omnidirectional mode only above a first lower cutoff frequency $f_{min1}$. Because of the fact that currents at points in symmetrical opposition are directed in opposite directions in space, the radiation contributions of these currents cancel one another out perpendicularly to the plane of spiral antenna 1 and are superimposed constructively in directions parallel to the plane of spiral antenna 1. The omnidirectional radiation mode is achieved in this way.

FIG. 3 shows half the path difference required for transmission represented by a double arrow, half the path difference corresponding to half wavelength λ/2, with the phase angle being inverted when this distance is traveled on adjacent spiral arms, as illustrated by the inversion of current vectors in FIG. 3.

In the zenith mode according to FIG. 4, second spiral arm 12 and fourth spiral arm 14 are supplied with a 180°0 phase difference, while first spiral arm 11 and third spiral arm 13, connected by first bridge 40 to first inner conductor 21 of coplanar conductor 2, are at a fixed zero potential in the middle between the potentials on second spiral arm 12 and fourth spiral arm 14. This yields a current distribution which is indicated by the single arrows according to FIG. 4 only on second spiral arm 12 and fourth spiral arm 14, while no current flows on first spiral arm 11 and third spiral arm 13, where coupling currents from adjacent current-carrying spiral arms are not to be taken into account. Likewise, with the help of the current distribution at the feed points represented by second inner spiral arm end 6 and fourth inner spiral arm end 8 and geometric considerations as in the case of the omnidirectional mode, the transmission region can be determined in the case of the zenith mode. Transmission also occurs in zenith mode at the location where currents in adjacent spiral arms are in phase even if they are separated by another currentless spiral arm. The currents in adjacent spiral arms 12, 14 separated only by first spiral arm 11 or third spiral arm 13 are then in phase when the path difference on second spiral arm 12 or on fourth spiral arm 14 between points in symmetrical opposition amounts to λ/2 or an odd multiple thereof. Since the currents at opposite feed points, i.e., at second inner spiral arm end 6 and fourth inner spiral arm end 8 point in the same direction in space, the currents at all symmetrically opposite points on second spiral arm 12 and fourth spiral arm 14 point in the same direction in space under this condition for the path difference, so the phase difference on second spiral arm 12 or on fourth spiral arm 14 amounts to 180° between these two symmetrically opposite points. Thus, transmission occurs at a second radius $r_2$ at which the circumference of second spiral arm 12 or fourth spiral arm 14 is equal to wavelength λ. The boundary condition here is also given by the fact that second radius $r_2$ cannot be greater than radius r of spiral antenna 1. Thus, a second lower cutoff frequency $f_{min2}$ is derived by $$\lambda=2\pi r_2=2\pi r$$

and defined by $$f_{min2}=c/(2\pi r).$$

Due to the fact that currents at symmetrically opposite points on second spiral arm 12 or fourth spiral arm 14 are pointing in the same direction in space, the radiation contributions of the currents perpendicular to the plane of spiral antenna 1 are superimposed constructively. This yields a transmission characteristic having its maximum perpendicular to the plane of spiral antenna 1, which is known as zenith radiation.

According to FIGS. 3 and 4, a spiral antenna in the form of an Archimedean spiral has been described. The form of spiral antenna 1 is not limited to purely Archimedean spirals, however. The spiral structure may also be logarithmic periodic.

Figure 5:
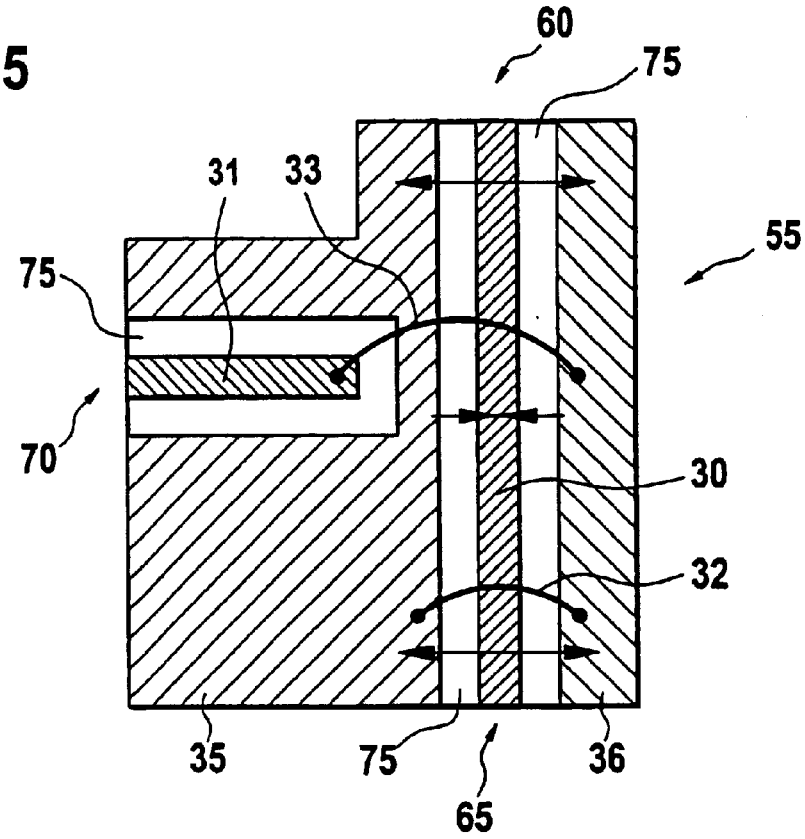
FIG. 5 shows a three-way gate having a symmetrical electric field distribution.
Figure 6:
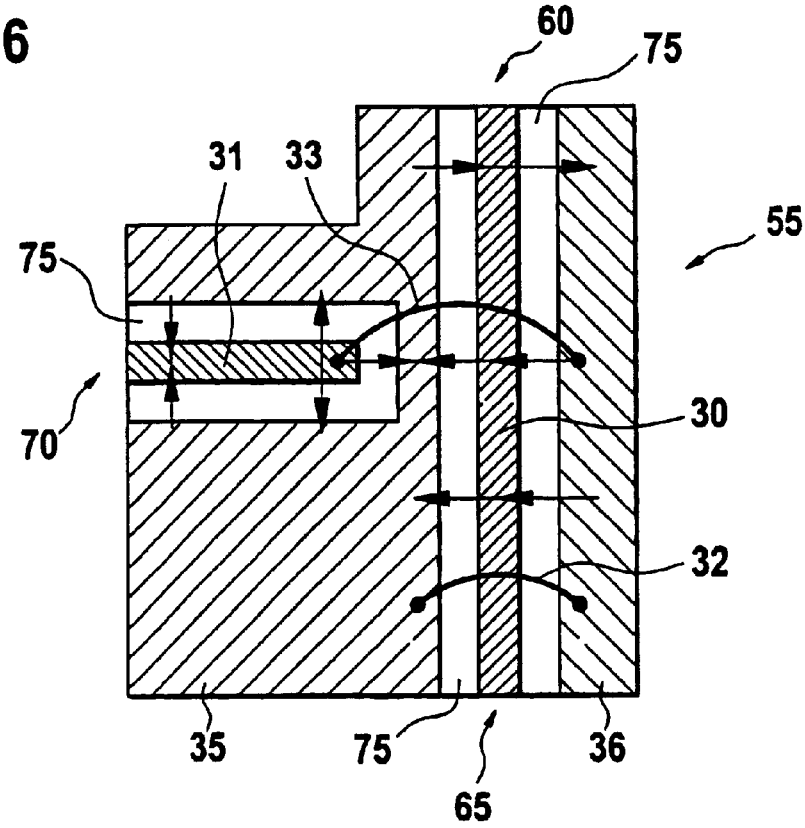
FIG. 6 shows a three-way gate having an asymmetrical electric field distribution.

The possibility of generating the two modes with coplanar conductor 2 to supply spiral antenna 1 is explained below on the basis of FIGS. 5 and 6. FIG. 5 shows a three-way gate 55 having a first gate 60, a second gate 65 and a third gate 70. Three-way gate 55 includes a third carrier material 75 which may be the same as or different from first carrier material 45 or second carrier material 50. A second inner conductor 30 is arranged on this third carrier material 75, and a third inner conductor 31 is also arranged perpendicular to it, second inner conductor 30 and third inner conductor 31 being galvanically separated and thus not in electric contact with one another. Three-way gate 55 also includes a third reference potential surface 35 and a fourth reference potential surface 36. Second inner conductor 30, third inner conductor 31, third reference potential surface 35 and fourth reference potential surface 36 are electrically conducting, e.g., made of metal. Second inner conductor 30 and third inner conductor 31 are electrically insulated from third reference potential surface 35 and fourth reference potential surface 36 by third carrier material 75 in the form of a slot surrounding respective inner conductor 30, 31. Second inner conductor 30 divides three-way gate 55 into a left half and a right half. In the left half, third inner conductor 31 runs perpendicular to second inner conductor 30. Third reference potential surface 35 is located exclusively in the left half of three-way gate 55. Fourth reference potential surface 36 is located exclusively in the right half of three-way gate 55. First gate 60 of three-way gate 55 is connected to the end of coplanar conductor 2 facing away from spiral antenna 1, second inner conductor 30 being connected to first inner conductor 21. Third reference potential surface 35 is connected to second reference potential surface 23 on first gate 60. Fourth reference potential surface 36 is connected to first reference potential surface 22 on first gate 60. At the end of second inner conductor 30 opposite first gate 60, three-way gate 55 includes second gate 65 which is also formed from first inner conductor 30, third reference potential surface 35, and fourth reference potential surface 36 and is used to supply signals for the omnidirectional mode. Third gate 70 is formed by third inner conductor 31 and third reference potential surface 35 and is used to supply signals for transmission in the zenith mode. Third reference potential surface 35 and fourth reference potential surface 36 are electrically connected to one another by a second electrically conducting bridge 32, e.g., a metallic bridge. Third inner conductor 31 is electrically connected to fourth reference potential surface 36 by a third electrically conducting bridge 33, e.g., a metallic bridge. Second bridge 32 is located at a distance from third bridge 33 in the direction of second gate 65.

Production of the omnidirectional transmission characteristic is achieved by the fact that the electric field distribution on signal supplying coplanar conductor 2 is symmetrical. This corresponds to the "odd mode." This symmetrical electric field distribution is represented in a snapshot according to FIG. 5 by arrows in the slots formed by third carrier material 75 between third reference potential surface 35 or fourth reference potential surface 36 and second inner conductor 30. Second bridge 32, which keeps third reference potential surface 35 and fourth reference potential surface 36 at the same potential on both sides of second inner conductor 30 does not have an interfering effect because in the "odd mode," third reference potential 35 and fourth reference potential surface 36 are at the same potential from the beginning. Thus, third bridge 33, which connects fourth reference potential surface 36 to third inner conductor 31, also does not cause interference because it also applies the potential of fourth reference potential surface 36 to third inner conductor 31. Third inner conductor 31 is thus isolated from second inner conductor 30.

Zenith mode is created on spiral antenna 1 by an asymmetrical electric field distribution on supplying coplanar conductor 2 and second inner conductor 30. FIG. 6 diagrams this field distribution, which is known as the "even mode," with corresponding arrows in the slots formed by third carrier material 75 between third reference potential surface 35 or fourth reference potential surface 36 and second inner conductor 30. In FIG. 6, the same reference numbers denote the same elements as in FIG. 5, because it is the same three-way gate 55. The asymmetrical electric field distribution can be produced by the arrangement of second inner conductor 30, third inner conductor 31, second bridge 32 and third bridge 33 on three-way gate 55 as described here. The "odd mode" is produced on third gate 70, resulting in a symmetrical electric field distribution between third inner conductor 31 and third reference potential surface 35, as represented by the arrows in the slots formed by third carrier material 75 between third reference potential surface 35 and third inner conductor 31 according to FIG. 6. Coupling of the "odd mode," which is simple to generate, from third gate 70 to first gate 60 is described in "Uniplanar MMIC—A Proposed New MMIC Structure" by Thirota, Y. Tarusawa, H. Agawa, *IEEE Transactions on Microwave Theory and Technics*, vol. 35, no. 6, pp. 576–581, June 1987. The "odd mode" produced on third gate 70 produces a potential difference between third inner conductor 31 and third reference potential surface 35. Fourth reference potential surface 36 is at the same potential as third inner conductor 31 due to third bridge 33. This results in a potential difference between third reference potential surface 35 and fourth reference potential surface 36. This potential difference produces an even mode which propagates in both directions between first gate 60 and second gate 65. To suppress propagation of the even mode in the direction of second gate 65 and thus in the direction of the feed for the omnidirectional mode, second bridge 32 is provided, keeping third reference potential surface 35 and fourth reference potential surface 36 at the same potential and thus suppressing the propagation of the even mode. The latter is reflected on second bridge 32 and propagates in the direction opposite from first gate 60. When second bridge 32 is mounted at a distance of a quarter wavelength from third bridge 33 based on the average operating frequency used, the even mode reflected on second bridge 32 and the even mode input by third gate 70 directly in the direction of first gate 60 are constructively superimposed, propagating as even mode in the direction of first gate 60 and thus toward spiral antenna 1.

In this way, third gate 70 is uncoupled from second gate 65. Since the finctioning described here is valid for sending as well as receiving with spiral antenna 1, two signals that are isolated from one another can be received at second gate 65 and at third gate 70, striking spiral antenna 1 from different directions in space.

The omnidirectional mode is created with the combined feed described here regardless of frequency, while production of the zenith mode is limited to certain frequency bands, depending on the position of second bridge 32. At the same time, the omnidirectional mode and the zenith mode can be supplied through three-way gate 55. Simultaneous reception in omnidirectional mode and in zenith mode is possible with three-way gate 55 described here. Simultaneously sending in one mode and receiving in the other mode are also possible with three-way gate 55 described here.

The lower cutoff frequency for transmission by spiral antenna 1 in the omnidirectional mode or in zenith mode is also influenced by the length of the taper on coplanar conductor 2. The lower cutoff frequency can be reduced if the taper on coplanar conductor 2 is lengthened.

The transition from coplanar conductor 2 to spiral antenna 1 is independent of the sudden change in the dielectric constants of the carrier materials. A first carrier material 45 having a low permittivity can be selected for spiral antenna 1, thus achieving good transmission, while at the same time selecting a second carrier material 50 having a high permittivity for coplanar conductor 2, which allows the length of coplanar conductor 2 to be reduced and suppresses parasitic transmission from coplanar conductor 2 and makes coplanar conductor 2 independent of the radiation field of spiral antenna 1.

Spiral antenna 1 is suitable in particular for flat installation in the body of a motor vehicle, in particular in the roof or trunk lid of the motor vehicle, because this permits an aerodynamic and aesthetic installation. This also yields a simple assembly of the spiral antenna in the body of the motor vehicle without requiring holes, thus also preventing corrosion spots in the vehicle body.

What is claimed is:

1. A spiral antenna, comprising:

four approximately parallel electrically conducting spiral arms; and a common coplanar conductor to which respective inner spiral arm ends of each of the spiral arms are connected for at least one of supplying and receiving a signal.

2. The spiral antenna according to claim 1, wherein:

the coplanar conductor includes an inner conductor and at least one reference potential surface, and the inner conductor and the at least one reference potential surface each are connected to two of the four inner spiral arm ends.

3. The spiral antenna according to claim 1, wherein:

the coplanar conductor is arranged perpendicular to a plane of the spiral antenna.

4. The spiral antenna according to claim 1, further comprising:

different carrier materials, wherein:

the coplanar conductor is mounted on one of the different carrier materials, and the spiral arms are mounted on another of the different carrier materials.

5. The spiral antenna according to claim 1, further comprising:

a carrier material, wherein:

the coplanar conductor and the spiral arms are applied to the carrier material.

6. The spiral antenna according to claim 1, wherein:

the coplanar conductor is formed as a taper at least in part.

7. The spiral antenna according to claim 6, wherein:

the taper is a linear taper.

8. The spiral antenna according to claim 6, wherein:

the taper is a nonlinear taper.

9. The spiral antenna according to claim 8, wherein:

the nonlinear taper is an exponential taper.

10. The spiral antenna according to claim 1, wherein:

the spiral arms are designed in the form of one of an Archimedean spiral and a logarithmic spiral.

11. The spiral antenna according to claim 1, wherein:

the coplanar conductor is supplied with a symmetrical electric field distribution to yield an omnidirectional transmission characteristic.

12. The spiral antenna according to claim 1, wherein:

the coplanar conductor is supplied with an asymmetrical electric field distribution to yield a directional transmission characteristic.

13. The spiral antenna according to claim 1, further comprising:

a three-way gate connected to the coplanar conductor.

14. The spiral antenna according to claim 13, wherein:

the three-way gate includes:

a first gate, a second gate, and a third gate.

15. The spiral antenna according to claim 14, wherein:

the first gate is connected to an end of the coplanar facing away from the spiral arms.

16. The spiral antenna according to claim 13, wherein:

the three way-gate includes:

a carrier material, a first conductor arranged on the carrier material, a second conductor arranged perpendicularly to the first conductor, the first conductor and the second conductor being galvanically separated from each other, a first reference potential surface, and a second reference potential surface, each one of the first conductor and the second conductor being arranged in respective slots in the carrier material in order to insulate the first conductor and the second conductor from the first reference potential surface and the second reference potential surface.

17. The spiral antenna according to claim 16, wherein:

the first conductor divides the three-way gate into a left half and a right half, the first reference potential surface is located exclusively in the left half, and the second reference potential surface is located exclusively in the right half.

18. The spiral antenna according to claim 16, wherein:

a first gate and a second gate of the three-way gate are formed by the first conductor, the first reference potential surface, and the second reference potential surface, and a third gate of the three-way gate is formed by the second conductor and the first reference potential surface.

19. The spiral antenna according to claim 16, further comprising:

a first conducting bridge by which the first reference potential surface and the second reference potential surface are connected; and a second conducting bridge by which the second conductor and the second reference potential surface are connected.

20. A motor vehicle, comprising:

a body; and a spiral antenna arranged at a location that is one of in and on the body, wherein the spiral antenna includes:

four approximately parallel electrically conducting spiral arms, and a common coplanar conductor to which respective inner spiral arm ends of each of the spiral arms are connected for at least one of supplying and receiving a signal.

* * * * *